US006603068B2

(12) United States Patent
Kondo

(10) Patent No.: US 6,603,068 B2
(45) Date of Patent: Aug. 5, 2003

(54) TUNING DEVICE

(75) Inventor: Masaji Kondo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/923,112

(22) Filed: Aug. 6, 2001

(65) Prior Publication Data

US 2002/0020280 A1 Feb. 21, 2002

(30) Foreign Application Priority Data

Aug. 18, 2000 (JP) ..... 2000-248749

(51) Int. Cl.[7] ..... G10G 7/02
(52) U.S. Cl. ..... 84/454; 439/76.1
(58) Field of Search ..... 439/76.1, 668, 439/669; 84/454–460

(56) References Cited

U.S. PATENT DOCUMENTS

| | | | | | |
|---|---|---|---|---|---|
| 4,363,531 | A | * | 12/1982 | Lancaster | 439/465 |
| 4,878,848 | A | * | 11/1989 | Ingalsbe | 439/76.1 |
| 5,967,854 | A | * | 10/1999 | Craig | 439/676 |
| 6,146,167 | A | * | 11/2000 | Kutsch | 439/188 |
| 6,386,891 | B1 | * | 5/2002 | Howard et al. | 439/76.1 |
| 2002/0019154 | A1 | * | 2/2002 | Na | 439/76.1 |

* cited by examiner

*Primary Examiner*—Jeffrey Donels
(74) *Attorney, Agent, or Firm*—Adams & Wilks

(57) ABSTRACT

There is provided a thin tuning device equipped with jacks for inputting or outputting a signal, the tuning device employs a main body case, a back case, and a printed board as parts of the components of the jacks so that the thickness of the jacks and of the tuning device can be reduced.

14 Claims, 5 Drawing Sheets

TUNING DEVICE

BACKGROUND OF THE INVENTION

1. Field of the Invention

The present invention relates to an input jack and an output jack of a tuning device for tuning a musical instrument.

2. Description of the Related Art

In a conventional tuning device, as shown in FIG. 5, a jack 9 available on the market is mounted on a printed board 3 by soldering 7 and the printed board 3 on which the jack 9 is mounted is accommodated in a main body case 1 and a back case 2.

However, in the above described conventional structure, the thickness of the tuning device main body is determined depending on the thickness of the jack 9, the thickness of the top part of the main body case 1, the thickness of the printed board 3 and the thickness of the bottom part of the back case 2, so that it has been difficult to reduce the thickness of the tuning device.

SUMMARY OF THE INVENTION

Thus, in order to solve the above described problem, it is an object of the present invention to reduce the thickness of jacks and of a tuning device by using a main body case and a back case of the tuning device and a printed board as parts of the components of the jacks.

To achieve the above described object, according to the present invention, there is provided a tuning device comprising a main body case, a back case, a printed board and jacks, wherein the main body case, the back case and the printed board of the tuning device are employed as parts of the components of the jacks so as to reduce the thickness of the jacks and of the tuning device.

BRIEF DESCRIPTION OF THE DRAWINGS

Other characteristics will appear on reading the following description with reference to the attached drawings in which.

DETAILED DESCRIPTION OF THE PREFERRED EMBODIMENT

An embodiment of a tuning device according to the present invention will now be described by referring to the accompanying drawings.

Figure 1:
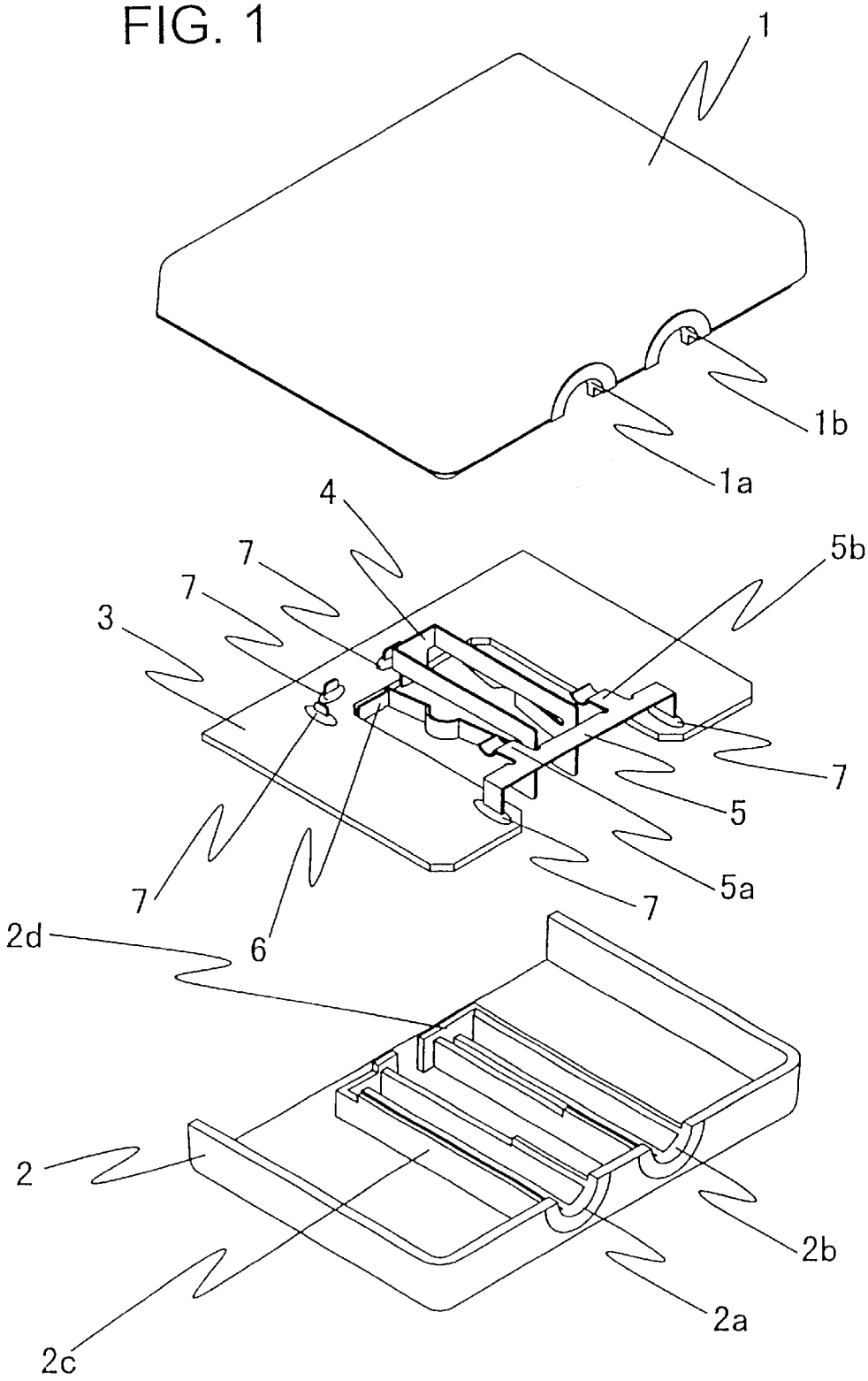
FIG. 1 is an exploded perspective view from a main body case side of a tuning device showing an embodiment of the present invention.
Figure 2:
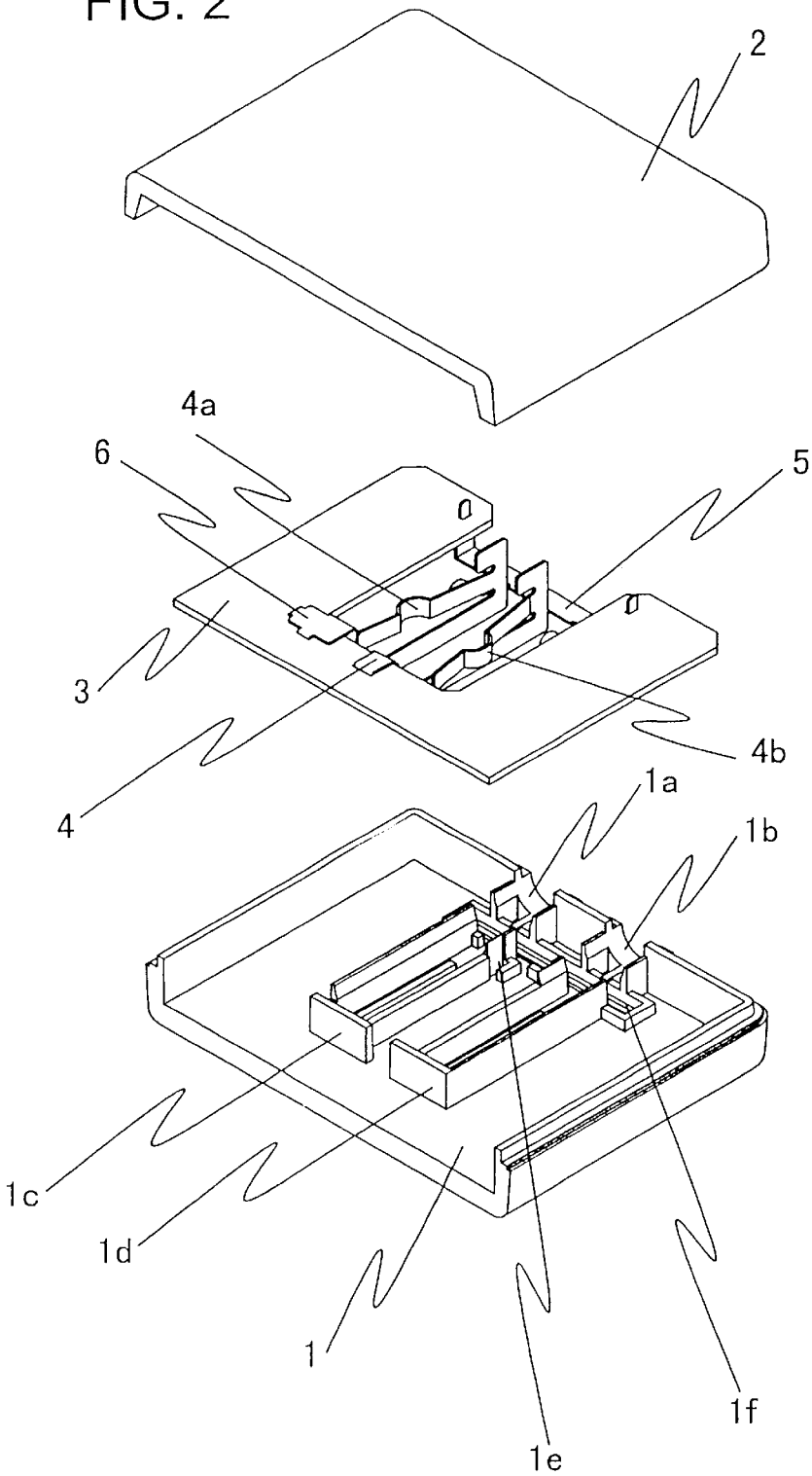
FIG. 2 is an exploded perspective view from a back case side of the tuning device showing the embodiment of the present invention.
Figure 3:
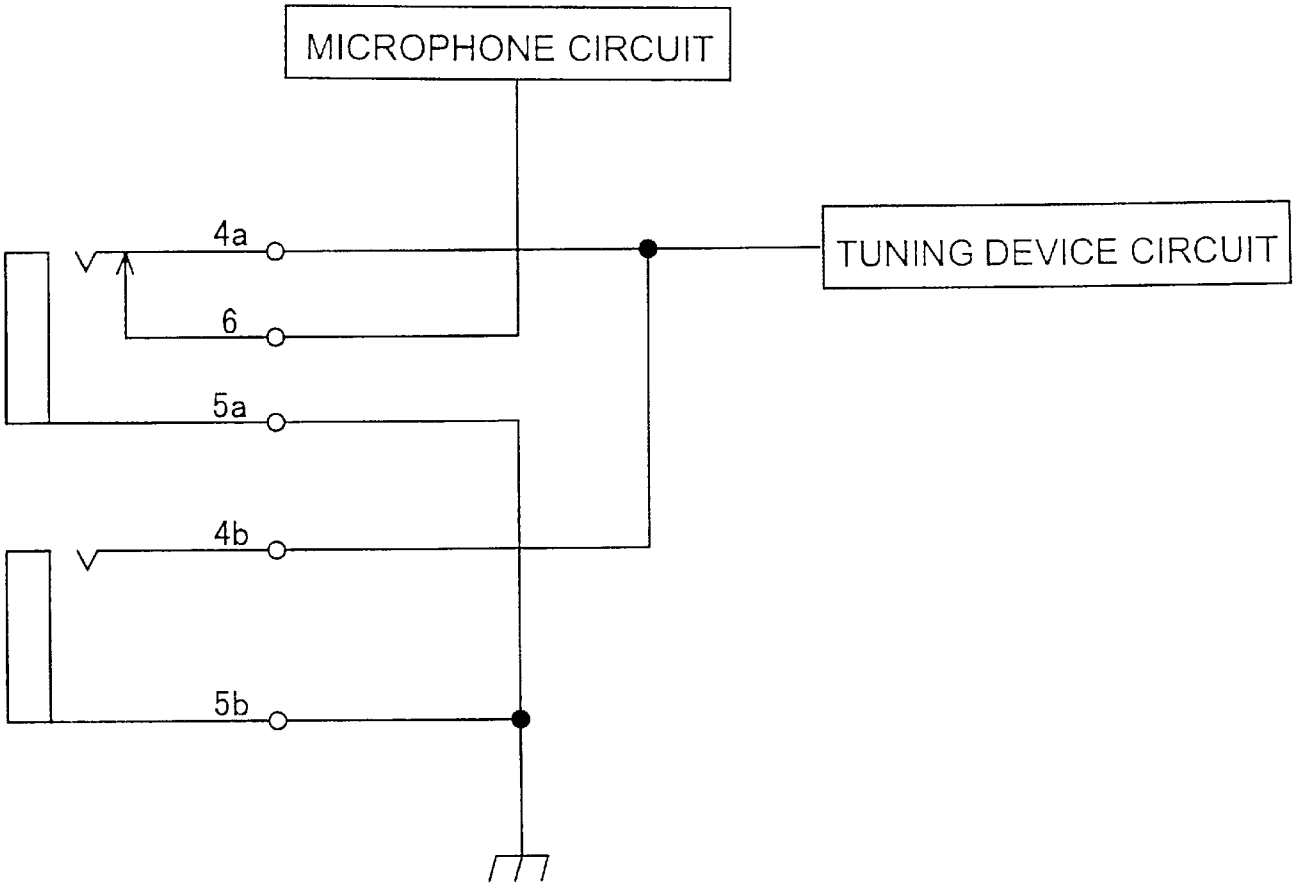
FIG. 3 is a circuit diagram of a jack part in the tuning device.

FIG. 1 is an exploded perspective view of a jack part from a main body case side which shows the structure of one embodiment of the tuning device according to the present invention. FIG. 2 is similarly an exploded perspective view of the jack part from a back case side which shows the structure of the tuning device according to the present invention. FIGS. 1 and 2 simply show only the jack part. Further, FIG. 3 is a circuit diagram of the jack part of the tuning device.

Hereinbelow, description will be made of the structure of the tuning device with reference to FIGS. 1, 2 and 3.

A printed board 3 to which a chip contact 4 as a contact member of a jack, a sleeve contact 5 and a break contact 6 are fixed by soldering 7 is mounted on a main body case 1. The printed board 3 has a cut-out part at its one end, and a plug is inserted into the cut-out part to come into contact with the respective contacts. At this time, the chip contact 4 on which a force is exerted by inserting the plug into or pulling the plug out from the cut-out part is supported by a chip contact support groove le formed in the main body case 1 and the sleeve contact 5 is similarly supported by a sleeve contact support groove 1*f* formed in the main body case 1.

The main body case 1 is fitted to a back case 2 so that an input plug insert part 1*a* and an output plug insert part 1*b* formed in the main body case 1 and an input plug insert part 2*a* and an output plug insert part 2*b* formed in the back case 2 form an input plug inserting part and an output plug inserting part. Further, a rib 1*c* formed in the main body case 1 and a rib 2*c* formed in the back case 2 form a guide for preventing a struggle of an input plug at the time of inserting the input plug. Further, a rib 1*d* formed in the main body case 1 and a rib 2*d* formed in the back case 2 form a guide for preventing a struggle of an output plug at the time of inserting the output plug.

In FIG. 3, a chip contact 4*a* of an input jack is electrically connected to a chip contact 4*b* of an output jack. Therefore, the chip contact 4 in which the chip contact 4*a* of the input jack is formed integrally with the chip contact 4*b* of the output jack is used so that the number of parts can be decreased. Further, in FIG. 3, a sleeve contact 5*a* of the input jack is electrically connected to a sleeve contact 5*b* of the output jack. Therefore, the sleeve in which the sleeve contact 5*a* of the input jack is formed integrally with the sleeve contact 5*b* of the output jack is employed so that the number of parts can be decreased.

As described above, the jack of the tuning device is composed of the main body case 1, the back case 2 and the printed board 3 on which the chip contact 4, the sleeve contact 5 and the break contact 6 are mounted, so that the respective contacts forming the jack are divided into upper and lower sides with respect to the printed board 3. Further, since the plug insert parts and the plug struggle preventing parts are formed by the main body case and the back case, the thickness of the jack part can be reduced.

Further, in the structure having the chip contact 4 and the sleeve contact 5 formed integrally in the input jack and the output jack, respectively, the number of parts can be decreased and the number of assembling steps can be simplified.

Figure 4:
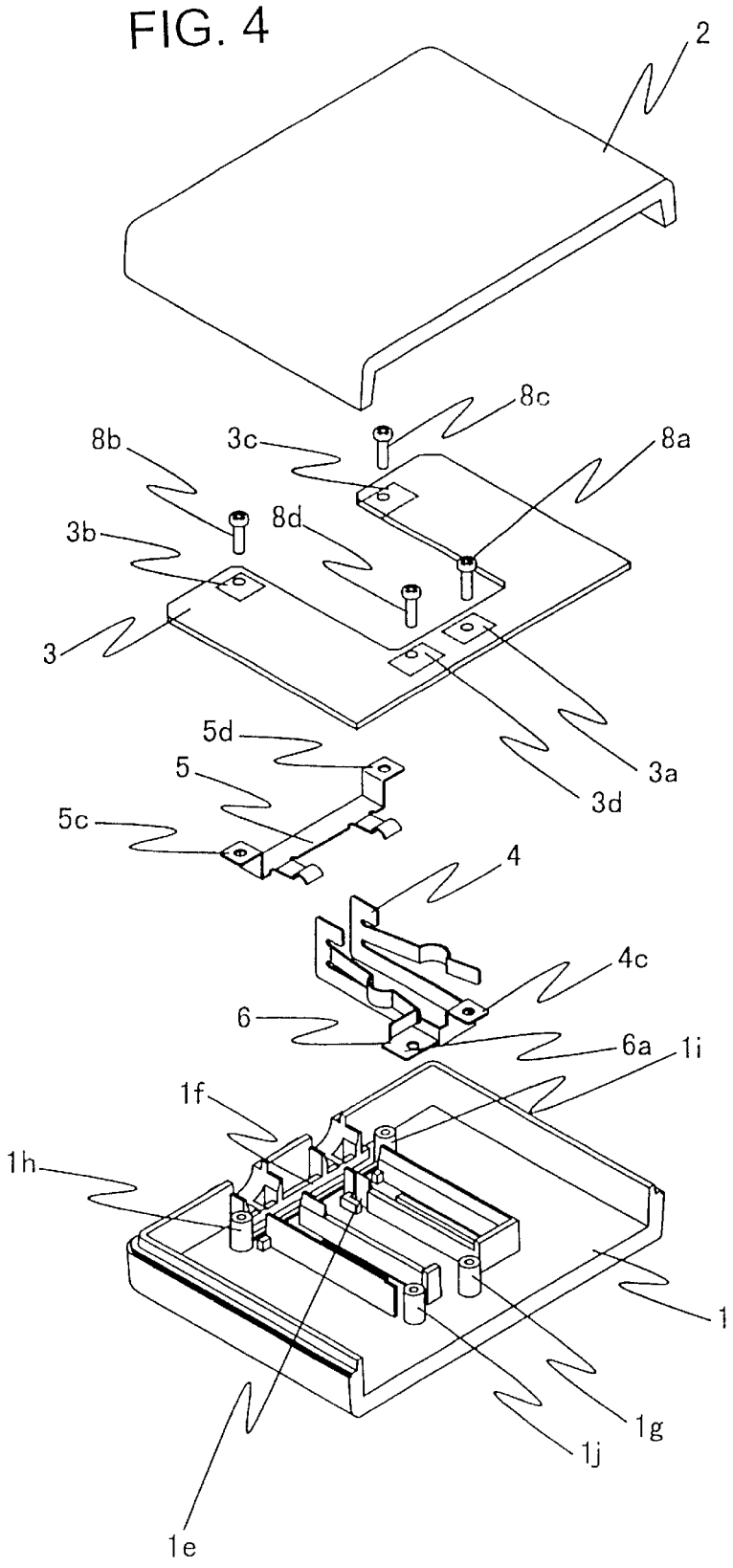
FIG. 4 is an exploded perspective view when the contacts of the jacks of the tuning device which shows the embodiment of the present invention are electrically communicated to a printed board by pressure welding.
Figure 5:
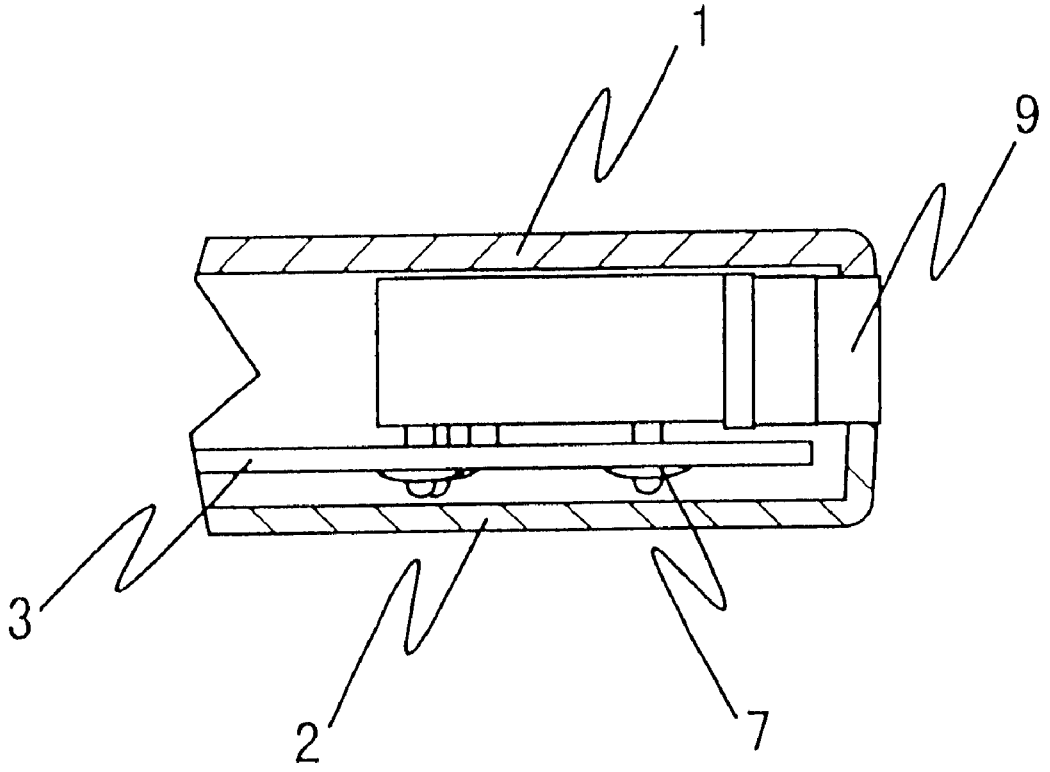
FIG. 5 PRIOR ART
FIG. 5 is a sectional view of a jack part showing the structure of a conventional tuning device.

FIG. 4 is an exploded perspective view of the embodiment when the chip contact 4, the sleeve contact 5, and the break contact 6 of the tuning device according to the present invention are electrically communicated to the printed board 3 by pressure welding. Its structure will now be described with reference to FIG. 4.

The chip contact 4 is mounted onto a chip contact support groove 1*e* and a chip contact attaching boss 1*g* formed in the main body case 1. Further, the sleeve contact 5 is mounted on to a sleeve contact support groove 1*f* and sleeve contact attaching bosses 1*h* and 1*i* formed in the main body case 1. The break contact 6 is mounted onto a break contact attaching boss 1*j* formed in the main body case 1. At this time, the chip contact 4*a* of the input jack of the chip contact 4 comes into contact with the break contact 6. The printed board 3 is mounted thereon and the chip contact 4 is fixed to the main case 1 and the printed board 3 by a screw 8*a* and the chip contact fixing boss 1*g*. Thus, a chip contact electrode 3*a* provided on the side surface of the main body case of the printed board 3 is press-welded to a screw fixing part 4*c* of the chip contact 4 to achieve the electrical communication of the chip contact 4. Further, the sleeve contact 5 is fixed to the main body case 1 and the printed board 3 by a screw 8*b* and the sleeve contact attaching boss 1*h*, and a screw 8*c* and the sleeve contact attaching boss 1*i*. Thus, sleeve contact electrodes 3*b* and 3*c* provided on the side surface of the main body case of the printed board 3 are press-welded to the screw fixing parts 5*c* and 5*d* of the sleeve contact 5 to achieve the electrical communication of the sleeve contact 5. Still further, the break contact 6 is fixed to the main body case 1 and the printed board 3 by a screw 8*d* and the break contact attaching boss 1*j*. Thus, a break contact electrode 3*d* provided on the side surface of the main body case of the printed board 3 is press-welded to the screw fixing part 6*a* of the break contact 6 to realize the electrical communication of the break contact 6. Further, the back case 2 is fitted to the main body case 1 so that the input jack and the output jack of the tuning device are formed.

In the jacks for the tuning device formed as described above, the thickness of the jack parts can be reduced. Furthermore, since the respective contacts are press-welded to the printed board 3 to realize an electrical communication, the accuracy in attaching the respective contacts to the printed board 3 upon mounting the contacts on the main body case 1 does not need to be paid attention to. Accordingly, the assembly steps can be further simplified.

As mentioned above, according to the present invention, since the main body case, the back case, and the printed board of the tuning device are employed as parts of the components of the jacks so that the respective contacts of the jacks are formed in the divided forms in the upper and lower sides with respect to the printed board, and the plug insert parts and the plug struggle preventing parts are formed by the main body case and the back case, the thickness of the jacks and of the tuning device can be reduced.

What is claimed is:

1. A tuning device comprising: an input jack for inputting musical sound from an electronic musical device; an output jack for outputting the musical sound input from the input jack to an external amplifier; a housing comprised of a main body case and a back case fitted to the main body case to define an input port and an output port; and a printed circuit board provided in the housing and having an electric circuit mounted thereon; wherein the main body case, the back case and the printed circuit board constitute and define the input jack and the output jack.

2. A tuning device according to claim 1; wherein the input and output jacks each have chip contacts for respectively connecting the jacks to the electric circuit and the external amplifier, the respective chip contacts being integrally formed with the input jack and the output jack.

3. A tuning device according to claim 1; wherein the input and output jacks each have sleeve contacts formed integrally therewith.

4. A tuning device according to claim 1; wherein the respective jacks have contacts that are press-welded to the printed circuit board to electrically connect the contacts to the printed circuit board.

5. A tuning device having a jack for inputting or outputting signals, the tuning device comprising:

a case having an insert port for receiving a plug;

a printed circuit board accommodated in the case and having a cut-out part at one end for accommodating the plug; and electrical contacts provided on the printed circuit board and disposed in the cut-out part so as to come into contact with the plug when the plug is inserted into the insert port.

6. A tuning device according to claim 1; wherein the main body case, the back case and the printed circuit board define sleeves for receiving and holding input and output plugs.

7. A tuning device according to claim 1; wherein the printed circuit board has a contact member mounted thereon provided with contacts for establishing electrical contact with input and output plugs.

8. A tuning device according to claim 7; wherein the printed circuit board has a cut-out portion, the contact member is disposed in the cut-out portion, and the input and output plugs extend into the cut-out portion to come into contact with the contact member.

9. A tuning device according to claim 7; wherein the contact member is press welded to contacts formed on the printed circuit board.

10. A tuning device according to claim 1; wherein the main body case and the back case each have cut-out portions and are mounted together such that the cut-out portions form insertion ports for input and output plugs.

11. In an electronic device having a jack for receiving an output plug of an electrical musical instrument, the jack comprising: a housing having an input port for receiving the plug; a printed circuit board disposed in the housing and having an electrical circuit thereon, the printed circuit board having a cut-out part positioned adjacent the input port so that the housing and the cut-out part define a sleeve for receiving the plug; and a contact member connected to the printed circuit board and having a flexible contact extending into the sleeve to establish electrical contact with the plug when the plug is inserted in the opening and to maintain the plug stationary in the sleeve.

12. A jack according to claim 11; further comprising chip contacts for connecting the jack to the electrical circuit.

13. A jack according to claim 11; wherein the jack has contacts that are press-welded to the printed circuit board to electrically connect the contacts to the printed circuit board.

14. A jack according to claim 11; wherein the housing comprises a main body case and a back case each having a cut-out portion and being mounted together such that the cut-out portions form the input port.

* * * * *